US007281466B1

(12) United States Patent
Wilksch et al.

(10) Patent No.: US 7,281,466 B1
(45) Date of Patent: Oct. 16, 2007

(54) PISTON COOLANT GALLERY

(75) Inventors: Mark Conrad Wilksch, Buckingham Bucks (GB); Philip Clive Franklin, Bicester (GB)

(73) Assignee: Seneca Technology, Ltd. (KY)

( * ) Notice: Subject to any disclaimer, the term of this patent is extended or adjusted under 35 U.S.C. 154(b) by 0 days.

(21) Appl. No.: 09/552,391

(22) Filed: Apr. 19, 2000

(30) Foreign Application Priority Data

Apr. 19, 1999 (GB) ..... 9909034

(51) Int. Cl.
*F01B 31/08* (2006.01)

(52) U.S. Cl. ..... 92/186

(58) Field of Classification Search ..... 92/186
See application file for complete search history.

(56) References Cited

U.S. PATENT DOCUMENTS 2,882,106 A * 4/1959 Meurer ..... 92/186
5,086,736 A 2/1992 Wiemann et al.

FOREIGN PATENT DOCUMENTS

DE 3830033 A1 11/1987
EP 0 403 767 A2 12/1990
EP 0 464 626 A1 1/1992

* cited by examiner

*Primary Examiner*—F. Daniel Lopez

(57) ABSTRACT

A cast piston, for an internal combustion engine or pump has an integral coolant ring gallery, with localized extensions, to achieve a coolant interchange with the gallery upon piston reciprocation. At least a portion of an extension lies generally parallel to the longitudinal piston axis and towards an upper end of the piston adjacent the working fluid. This provides an attendant increase in surface area exposed to coolant allowing either a decrease in operational piston temperature or an increase in allowable heat flow into the piston from a working fluid.

20 Claims, 5 Drawing Sheets

(PRIOR ART) FIG.6B (PRIOR ART) FIG.7A

PISTON COOLANT GALLERY

TECHNICAL FIELD

The present invention relates to cooling systems for piston mechanisms, and more particularly to pistons with coolant gallery configurations.

BACKGROUND

In a piston for a positive-displacement, reciprocating piston-in-cylinder device, such as an internal combustion engine prime mover or a pump, the (upper) part of the piston nearest the working fluid commonly incorporates a coolant gallery, for a coolant, or more specifically (fluid) heat transfer medium, typically a liquid, such as a lubricating oil. For a cast piston, such a coolant gallery can be integrally cast within it. This is typical of current aluminum alloy pistons for medium-duty diesel engines.

In striving for (energy conversion and thermodynamic) efficiency, reduced emissions and enhanced "user satisfaction", internal combustion engine design must balance conflicting requirements. The materials used in the construction of such engines are under severe stress and there is little margin between a robust, cost-effective design and one that will have insufficient durability. Reduced size and weight is a key benefit for customers, yet increased power is also often required.

A fundamental limit upon the compression ratio of a spark-ignition, gasoline engine, and hence its thermodynamic and fuel combustion efficiency, is the phenomenon of pre-ignition, or "knock", that is, uncontrolled explosion, rather than progressive timed combustion. The destructive effect of knock is well-known, and much effort has been expended in its resolution. In gasoline engines, the influence of piston temperature upon pre-ignition and knock is relatively minor, but well-known.

Generally, any reduction in combustion chamber temperatures will directly influence fuel combustion efficiency. Compression-ignition (diesel) engines do not suffer the severe problems of preignition or knock attendant spark-ignition, gasoline engines and so they can be made in much greater sizes and run at much higher levels of super-charge. However, the high compression ratios employed by diesel engines for higher thermodynamic and fuel combustion efficiency have led to diesel engine pistons needing sophisticated piston cooling systems. This has long been recognized and prompted a plethora of designs.

Until the advent of finite element stress analysis, the extremely complicated thermal and mechanical stresses in pistons could not be effectively calculated and so piston designers had limited formal (quantifiable) guidance. Many complex and imaginative solutions were tried, but few were successful. Also, the cast aluminum alloy piston continued to be superior and less expensive in smaller engines. However, the problem of piston temperature remained.

Component cooling around the working fluid is a trenchant problem. Component temperatures need to be kept low because most materials suffer a reduction in strength at elevated temperature. The coolant also degrades if the wetted surfaces become too hot. High thermal gradients in components, arising from intensive heating and cooling, also produce high thermal stresses. Increased engine rating exacerbates this problem considerably and much attention has been devoted to improving component cooling.

A piston is closest to the working fluid and the intense heat of combustion and is thus the component most vulnerable to thermal and mechanical stresses and shock. Piston structures suffer localized extreme temperature gradients and working pressures. The risk of material failure due to overheating can be eased by the provision of effective internal piston cooling. In that regard, a piston represents a key engine component and as such is a major contributor to performance and reliability. Consequently, in piston engine development, piston temperature and hence piston cooling has long been an important issue.

Designers of larger engines, where component cost is less of an issue and the greater size allows more design freedom, frequently multi-piece pistons are utilized, often with steel crowns. These crowns often have complex geometries to provide cooling where it is most needed and a temperature profile that is carefully calculated to give the longest life and optimum engine performance. Some (e.g. as described in 1981 CIMAC paper 0109) have used a ring gallery (created by the space between crown and body), together with a series of drilled blind or closed-ended holes. The ring gallery disposition allows coolant fluid (such as lubrication oil) to come close to sensitive or vulnerable areas of the piston, i.e. where adverse temperatures and thermal stresses are most acute or less readily accommodated.

Blind holes do not allow fluid to flow in the normal (e.g. coherent uni-directional, continuous, closed-loop, re-circulatory) sense. However, because of the severe accelerations experienced by the piston in its reciprocating motion, coolant fluid is thrown into and out of the holes upon each piston reversal and hence has high, albeit intermittent, flow velocities, in relation to the sides of these blind holes, thus promoting heat transfer.

For smaller engines where initial cost (i.e. original manufacturing, as opposed to service-life) is more important and space is limited, hitherto known blind-hole coolant gallery configurations have proved impractical for the majority of applications.

Many minor modifications to galleries have been proposed hitherto, with specially shaped entrances and exits, tilted axes, convergent or divergent walls, etc. but none of these have achieved a significant increase in overall surface area for heat transfer through a coolant medium.

In one approach an oil jet projecting oil at the underside of the cast aluminum piston was the easiest and lease expensive solution, but one which only increased the allowable rating by some 25–30%. Multi-piece piston of relatively simple architecture were devised with one or two substantially circular cavities, through which oil could be passed. These pistons succeeded where the more complicated versions had failed. This was largely due to a simple architecture and generous profile transitions or end radii which inhibited initiation of thermal cracking. These pistons had less effective cooling than many more complex designs, and so operated at higher temperatures, but their simplicity of construction entailed lower stress levels.

Latterly, with the advent of finite element (FE) stress analysis techniques, some more complex features were reintroduced, but with the benefit of a computational tool allowing modeling and evaluation of the implications of design proposals before manufacture. Single-piece, cast pistons were also developed, incorporating more complex cooling features than merely an under-crown oil jet.

Simple "open gallery" designs 50 such as depicted in FIGS. 4A through 4C where cavities were cast in above the piston pin bosses gave a modest, but still useful, increase in rating capability (circa 15%) because the oil had a greater wetted contact surface area over which to extract heat. The oil supply was again by standing jet, and the galleries were virtually emptied at every bottom-dead-center (BDC), by high piston acceleration.

Another approach was a "cooling coil" design 55 such as depicted in FIGS. 5A through 5C, in which a copper or steel tube 56 was coiled into a spiral and cast into the piston body. Holes for oil feed and drain were provided, and coolant (typically oil) was fed up a passage or oil-way (drilled) in the connecting rod and, either by a slipper arrangement up a hole at the center of the under-crown (as shown in FIGS. 5A and 5C), or by a fairly tortuous route, via the piston pin and (cast and/or drilled) passages, through the pin boss.

Experimentation showed that the heat transfer coefficient of the piston/oil interface was at its greatest when the oil only partially filled the cavity in the piston, and was thrown violently against the walls of the gallery by piston acceleration. Such a "cocktail shaker" approach became a standard technique for oil cooling and coolant channels filled with oil gradually died out.

The narrow channels of a cooling coil could not be run only partially-filled, because the oil flow-rate required to carry away the heat flow could only be sustained in such narrow passages by filling them with oil. Thus, although they could be produced with somewhat increased surface area, as compared with, say, a single toroidal gallery, cooling-coil pistons were not pursued.

Instead, for highly rated engines with aluminum pistons, a generally toroidal gallery with jet feed into a drilled inlet were utilized. This is depicted as a "full gallery" piston 60 in FIGS. 6A through 6C.

A variant is a "horseshoe gallery" piston design 65, such as depicted in FIGS. 7A through 7C, where oil flows only one way around the piston, from inlet to drain, rather than splitting and travelling in both directions.

Many, many different features have been tried on galleries to increase their efficiency, but without an analytical tool capable of predicting the flows at a detail level, there was little prospect of progress, except by accident. Nevertheless, certain successful features addressed critical factors such as the temperature of the top ring groove 185 in FIG. 8B, (because of oil carbonisation); the combined thermal and mechanical stress at the edge of the combustion bowl 189 in FIG. 8B, and the combined stresses around the gallery (principal compressive stress) shown as 188 in FIG. 8B. Also, the dimensions 181, 182, 183 and 184 around the gallery(s) require careful selection and control for a robust design.

FIG. 8A shows a known coolant gallery configuration developed by Associated Engineering and adopted in Japan. Although the gallery 82 is not large, by making it from a fabrication attached to the back of the top ring insert 81, the temperature at the top ring groove 86 is reduced. The close proximity to the sensitive area of the combustion bowl edge 89 also enables this gallery to reduce the temperature significantly at this point. Feed and drain holes 83 usually have to be drilled at an angle, because of the limited space available. The limited surface area available for heat transfer means that the bulk piston temperature is not reduced as much as is possible.

FIG. 9A shows a localized (entrapment or capture barrier) "weir" 93 used around the junction of a gallery 91 and a drain passage 92 to prevent the gallery 91 emptying of oil at every bottom dead center and also when the engine is stopped. This feature was commonly adopted, but careful sizing of inlet and drain holes, to match them to the gallery size and the oil flow rate, has made this feature redundant.

FIG. 9B shows a "swept bend" inlet hole 102, together with a diffuser 103, before the oil enters the main gallery at diameter 101. The effectiveness of this proposal is unknown, but it could be useful to harness the high velocity of the jet (typically around 20 m/s) in order to enhance the oil velocity along the walls of the gallery.

FIG. 9C shows a typical inlet, with conical section 113 at the entrance of a feed passage 112 to a gallery 111. This is an attempt to capture an (oil) jet, even if it is somewhat divergent, or cannot be aimed straight at the entrance at all piston positions, as the piston travels up and down the cylinder. It is commonly used on many of the jet-fed galleries.

Many of the features described can be used together, and there are many more that can be included. Also, current developments of computational fluid dynamics are becoming capable of calculating the flows of oil and heat in a piston coolant gallery and thus can analyze the effect of geometric variations.

In general, the important factors that influence coolant gallery effectiveness are the mean oil velocity at the surface; the gallery wetted area; the gallery position (mean heat path from source to oil); the gallery surface condition; and the coolant (oil) properties. Other major factors influencing piston temperature include the mean in-cylinder gas temperature; the piston crown area; the piston crown surface heat transfer coefficients (dominated by gas velocities and mean cylinder pressure); and the heat transfer coefficients to cylinder walls.

Although many complex shapes have been proposed for machined coolant galleries, in multi-piece pistons, these have all had to be readily reproducible by (selective material removal) tooling, whether cutter, spark-erosion or chemical milling.

Pistons of aluminum alloy, with cast in coolant galleries, are well established. Indeed, the majority of pistons are made of aluminum alloy, because of its all-round cost-effectiveness.

Cast galleries have tended to be very simple, partly because of the limitations of the foundry processes, and also because of the dangers of introducing stress raisers. Any deviation from a simple form will raise stresses; those deviations lying substantially perpendicularly to the principal stresses having the greatest effect. Foundry processes are also such that changes in section are always accompanied by the danger of porosity, "cold-shuts", and other similar defects that effect the integrity and strength of the metal locally. Hitherto, particularly in cast pistons, the coolant gallery has remained configured as generally a relatively crude heat-transfer system.

The usual method of manufacture is to use a water-soluble core of salt, which is placed in a die, prior to pouring molten aluminum alloy. Early processes used a mixture of salt and foundry resin (such as is commonly used with foundry sands); the resin being thought necessary to bind the grains of salt together. Foundry process development recognized that the salt grains would bind together successfully, if pressed together at moderate pressures, and also gain some more strength, if the cores were sintered at elevated temperature. Thus the salt cores could be made more accurately, with less so-called "out-gassing" arising, since foundry resins produce gas, when exposed to the molten metal. This allowed successful casting of finer and more intricate detail in piston features.

In a foundry casting process, after the piston has cooled, the core is washed away with a high pressure jet of water which rapidly dissolves the salt. This leaves a (through) hole or pocket (to form an intended coolant gallery or passage), within and/or through which a suitable coolant fluid, such as lubrication oil, can be passed, when operating an engine in which the piston is installed.

Incorporation of a coolant gallery into the piston entails some additional cost, but its overall cost-effectiveness is witnessed by its widespread adoption in highly-rated diesel engines, where piston temperatures would otherwise pose a problem.

SUMMARY OF THE INVENTION

According to one aspect of the invention, a piston coolant gallery incorporates discrete (lateral) extensions, departures, or offshoots, of a coolant pathway, in order to increase the surface area locally, for exposure to, and contact with, a coolant fluid—such as a lubricating oil. Such a coolant gallery configuration is particularly suited to implementation in a cast piston construction. The attendant increase in surface area exposed to, and wetted by, coolant, results in either a decrease in piston temperatures; or an increase in the allowable heat flow into the piston from the working fluid. Such supplementary extensions, according to the invention, materially improve the cooling of cast pistons with galleries, at minimal additional cost or complexity.

The consequent improved cooling may be used in a number of ways, for example, to reduce piston temperature, allow higher engine rating, or allow for increased gas temperatures (e.g. as produced by the use of exhaust gas recirculation). A coolant gallery (extension) cross-sectional profile that gives the best compromise, and leads to the greatest surface area available for heat transfer, is a form of canted oval. This gives a generous radius adjacent to dimensions 181 and 183 mentioned earlier thus minimizing the stress raising effect as well as ensuring that the dimensions 181, 182, 183, and 184 are within guidelines. There is no easy check on the stresses—and ideally all pistons should be analyzed, say, by an FE technique, to ensure their robustness.

Some embodiments of the present invention utilize a casting (which may be of aluminium alloy, cast iron, or other suitable material), with a ring gallery, but the gallery being enhanced, by a multiplicity of surface extensions, lateral off-shoots, or projections which increase the surface area wetted by the coolant fluid, and also increase the turbulence of the fluid on (all) the internal surfaces.

Such supplementary coolant (ring) gallery extensions may advantageously lie substantially aligned with (i.e. along and/or parallel to) the (longitudinal reciprocating) axis of the piston, and may conveniently be made conical with a spherical radius at the cone apex, rather than a sharp point. This geometry provides a core that is easily re-producible (e.g. in pressed salt) by modern manufacturing methods at little on-cost compared with the core for a conventional ring gallery.

The spherical radius aids both manufacturing and operation, but similar or equivalent profiles could also be utilized. However, conical projections have built-in draft angle, which simplifies core production.

Stresses in pistons are very complex, however, and principal stresses arise primarily from the pressure in the working fluid, accelerations, and thermal growth. Gallery extension or projection features, according to the present invention, may raise stresses (locally). However, if, as is preferred, the extensions envisaged, according to the invention, lie substantially parallel to the piston longitudinal axis, they act as only minor stress raisers in relation to overall stresses.

A somewhat larger coolant gallery of conventional form, and one which had the same surface area as a gallery with supplementary extensions as envisaged in the present invention would also cause an increase in stresses which would be greater than that engendered by the very extension features envisaged according to the invention. Higher stresses of a conventional gallery merely enlarged would be associated with the increased size itself—reducing the amount of metal available to carry the loads, an attendant increase in stress concentration because of a gallery orientation perpendicular to the direction of compressive stress arising from cylinder pressure, and an increase in stress arising from thermal growth, again due to its large size. In any event, in many cases it would be difficult to find room for a larger (conventional) gallery. Thus, a larger conventional gallery would have to be positioned further from adjacent cast features, since the large core presence would otherwise interfere with metal flow during casting.

Multiple, individually localized, gallery extensions according to the invention—with their local reduction of section thickness—are much less problematic. Generally, in casting such localized gallery extensions, a salt core would have to be positioned with respect to the cast under-crown, the Ni-resist insert (if present), and an adequate distance from machined features such as bowl and ring grooves.

In the case of conventional pistons using substantial section piston (gudgeon) pins to connect the piston to the small end of the connecting rod, bending stresses arising from lack of support of the piston at its center (i.e. between bosses), and "wrap" of the piston around the piston pin, both introduce distortions of the stress field. Extensions running substantially along, or parallel to, the axis of the piston will act as stress raisers to any of the stresses that are not along the axis of the piston, because of the bending described above. These stresses are not the major stresses in the piston, but the stress-raising effect of the extensions will make the situation somewhat worse.

In the case of spherical-jointed pistons, where a substantive piston pin is replaced by a ball-and-socket joint, stress analysis is somewhat easier and the bending stresses described above do not arise, so cannot be amplified by the extensions.

Generally, any significant extension will increase the surface area exposed to the coolant. Conventional feed and drain holes, spokes etc., have addressed this rather arbitrarily in past designs. However, there has been no previous attempt to include a multiplicity of such features in a cast gallery (in a cast piston) for the express purpose of (coherently) improving cooling, by increasing the wetted surface area, as envisaged according to the present invention.

BRIEF DESCRIPTION OF THE DRAWINGS

There now follows a description of some particular embodiments of the invention, by way of example only, with reference to the accompanying diagrammatic and schematic drawings, in which:

FIGS. 4A–C, 5A–C, 6A–C, and 7A–C, 8A–B, and 9A–C show diverse prior art piston gallery configurations. More specifically, FIGS. 4A through 4C show a prior art open coolant gallery piston configuration;

FIGS. 5A through 5C show a prior art cooling coil gallery piston configuration;

FIGS. 6A through 6C show a prior art full coolant gallery piston configuration;

FIGS. 7A through 7C show a prior art "horseshoe" coolant gallery piston configuration;

FIGS. 8A and 8B show part cut-away, part-sectioned details of alternative piston gallery configurations; and FIGS. 9A through 9C show alternative coolant gallery path configurations.

DESCRIPTION OF THE PREFERRED EMBODIMENT(S)

The terms "upper" and "lower" as used herein relate only to relative positions of components shown in the diagram. In a working engine, or pump, the components may be arranged in any appropriate orientation consistent with provision for lubrication, cooling, fuel feed and combustion intake and exhaust flows.

Figure 1:
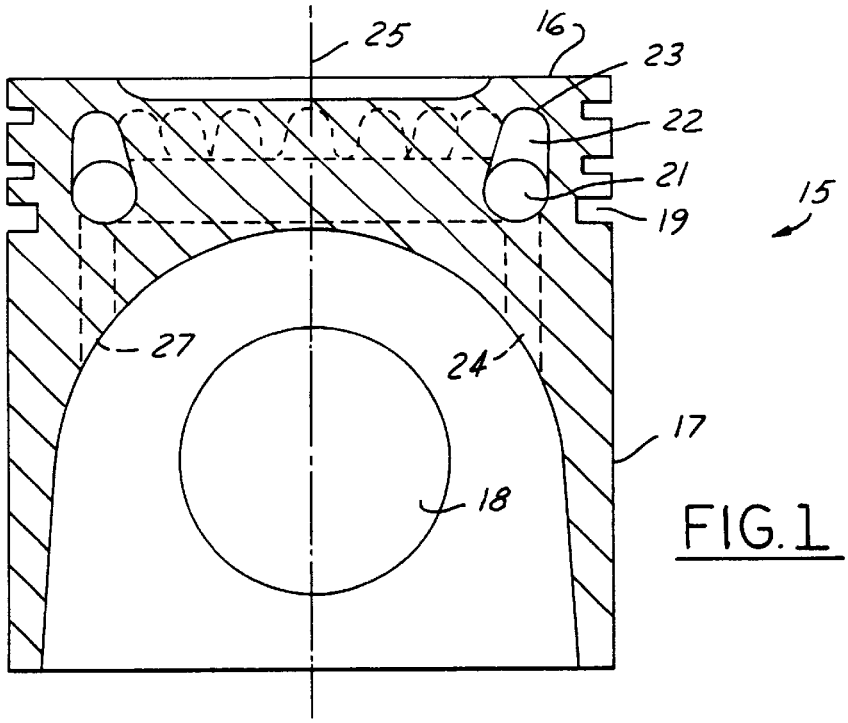
FIG. 1 shows a sectional view of a piston with a coolant gallery incorporating extensions or projections according to the invention.
Figure 2:
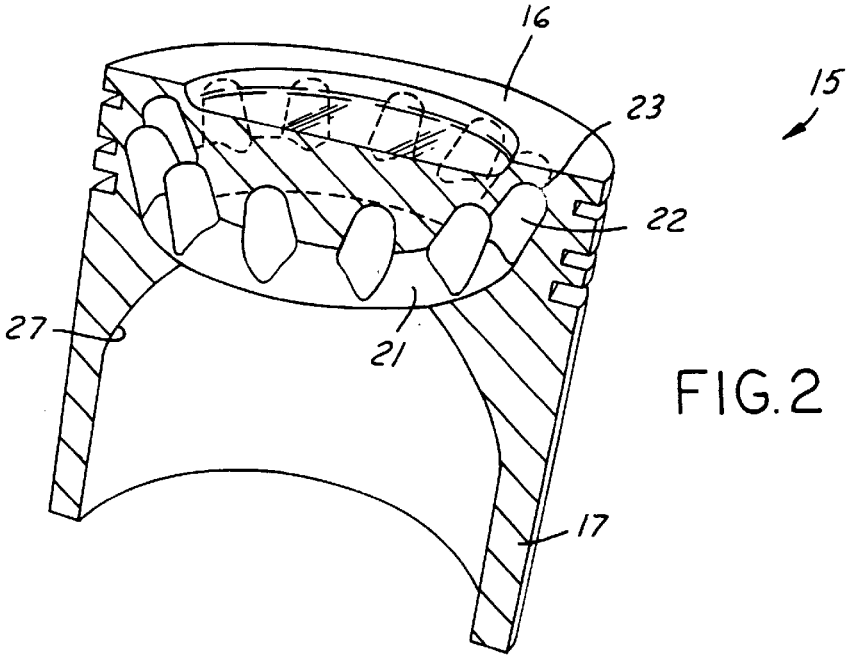
FIG. 2 shows a three-dimensional, part-sectioned, part cut-away view of the extended coolant gallery of FIG. 1.

Referring to the drawing(s), and in particular FIG. 1, a (cast) piston 15, is of generally cylindrical form, with a hollow underside 27, to house the small end of a connecting rod (not shown), through a transverse pin 18. In a conventional piston, with a gudgeon or wrist pin, bearing is taken at the piston walls.

Alternatively, a spherically-jointed piston configuration (not shown), with a part-spherical bearing surface on the piston underside, interfacing with a complementary, part-spherical bearing surface upon a connecting rod small end, and located by a retaining ring, also with a part-spherical bearing surface, and fitted to the piston internal wall, is compatible with the present invention.

The piston 15 is conveniently formed by casting, in, for example, an aluminum alloy. The piston 15 has a crown 16, a hollow underside bounded by peripheral skirt 17 and multiple stacked bands of circumferential locating grooves 19 at its upper end, for locating piston expansion rings (not shown). Marginally below the piston crown 16, an integrally-cast coolant gallery 21 is configured as an annular ring, in this example of circular cross-section. In the case of an internal combustion engine, the coolant (not shown) would typically be a lubrication oil.

A circumferentially-spaced array of localized, lateral extensions or projections 22, individually of generally conical form, with curved end noses or tips 23, is directed upwardly from the ring 21 towards the piston crown 16, and generally in a direction parallel to the longitudinal (reciprocating) axis 25 of the piston 15. The coolant ring 21 communicates with the underside 27 of the piston 15, through a series of coolant feed and/or drain passages 24, generally parallel to the piston longitudinal axis 25.

Piston reciprocatory motion along its axis, engenders a pulsating coolant interchange between the localized gallery extensions 22 and the coolant gallery 21 itself and also between the coolant gallery dedicated coolant feed or supply pathways, in, for example, the connecting rod and bearing connection. The effect may be likened to a "cocktail-shaker" disturbance mode, for thorough intermingling of heated and cooled coolant masses.

Generally, the coolant gallery could be configured as a closed or part-closed (e.g. horse-shoe) shaped annulus or ring, either largely in a common plane, or a progressive departure therefrom, as, for example, in a helical or toroidal form. The casting gives greater freedom of form than would necessarily be economic, or even feasible, with machining. Variant coolant gallery configurations are depicted in FIGS. 3A through 3E. Of these, the version shown in FIG. 3A has been studied at greater length than the other variants. It is envisaged that the gallery extensions 22 would be equi-spaced, circumferentially around the gallery (annulus or) toroid 21. The toroid 21 may be of circular, or other cross-section, but could generally be about two thirds of the cross-section of an equivalent plain gallery.

Figure 3A:
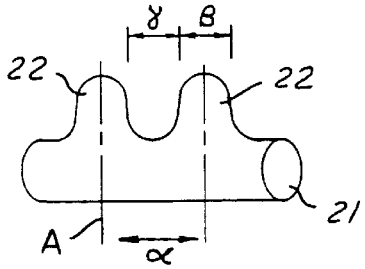
FIGS. 3A through 3J show variant coolant gallery extension configurations according to the invention.
Figure 3B:
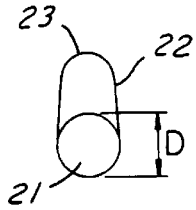

One design factor, or consideration, in gallery configuration is for the extension or projection spacing, "gamma", to be approximately equal to the width of an extension or projection, "beta". This is shown in FIGS. 3A and 3B. Another gallery design factor is for the toroid to have a mean diameter approximately some 70% of the piston diameter.

A further gallery design factor is for the height of the extensions 22 to be between about 50% and 150% of the diameter "D" of the gallery toroid 21. Yet another gallery design factor is for the width, beta, of the extensions 22 to be some 75% of the gallery diameter "D". Such gallery design considerations could be combined, or factored together and an optimizing balance, or compromise, struck.

Some "draft angle" or (plug extraction) taper on the extensions 22 would aid the production of the cores, so the final shape is conical with a radiused end tip 23. The spacing interval or pitch, "alpha", of the extensions 22 would typically be between some twenty-four and twelve degrees (24°–12°), which would provide between 15 and 30 extensions 22 around the gallery. A uniform or symmetrical spacing is convenient. In one case studied, the optimum was found to be twenty-four gallery extensions.

The axis "A" of the extensions 22 should generally lie approximately parallel to the direction of the maximum principal stress in the region of the gallery—for the least stress-raising effect.

For a high peak cylinder pressure application (>250 bar), the direction of maximum principal compressive stress will be approximately parallel to the piston axis.

A typical plain gallery designed according to conventional principles would have a surface area approximately the same as the cylinder bore area. This can typically be increased, by some 40%, with the use of coolant gallery extensions according to the present invention, yet the calculated life was not reduced.

Figure 3C:
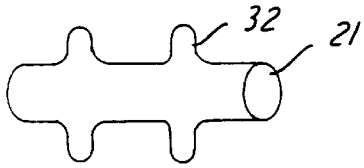
Figure 3D:
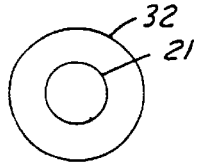
Figure 3E:
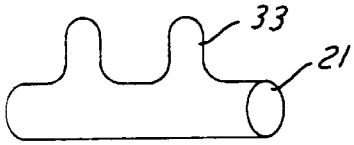
Figure 3F:
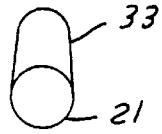

FIGS. 3E and 3F shows a coolant gallery variant with similar extensions 33, yet flattened, or more thinner or compact, radially. This can be used to increase surface area still further, but, for smaller pistons (i.e., those less than approximately 120 mm), the limitations of casting practice are such that this approach may not be viable.

Generally, the minimum core thickness for the extensions and minimum metal thickness between the extensions should be greater than approximately 4 mm. The tooling for the core is also somewhat more difficult to produce. Such a profile would not be feasible in a machined multi-piece piston, but the benefit of extra wetted area would give a useful increase in cooling capability for larger pistons.

If, as illustrated, the pitch is left the same (to allow for the foundry capabilities), the wetted area will actually be somewhat reduced, compared to FIG. 3A, so this approach would not be advantageous on smaller pistons.

The coolant gallery variant of FIGS. 3C and 3D uses a series of rings 32, similar to cooling fins, in order to increase the surface area, both locally and overall. This would be suitable for those cases where the "hoop stresses" all around the gallery were low. It also requires extra space.

Figure 3G:
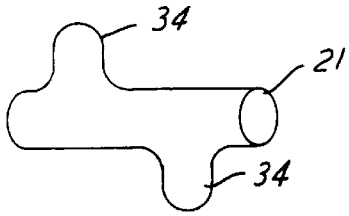
Figure 3H:
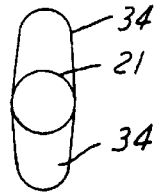

The coolant gallery variant of FIGS. 3G and 3H uses extensions 34, orientated alternately up and down from a (toroidal) gallery 21. The extensions need not be of the same shape or size-either around the circumference of the gallery or above and below the gallery. Extensions in the "downward" direction would have the benefit of trapping oil at bottom dead center, but would be somewhat less effective at removing heat from the piston, as this region of the piston is cooler. This version may be useful if some obstruction (e.g. an offset combustion bowl) obstructs the upward extensions at some points.

Figure 3I:
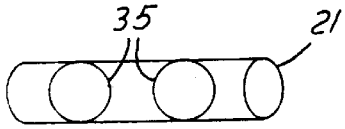
Figure 3J:
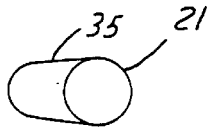
Figure 4A:
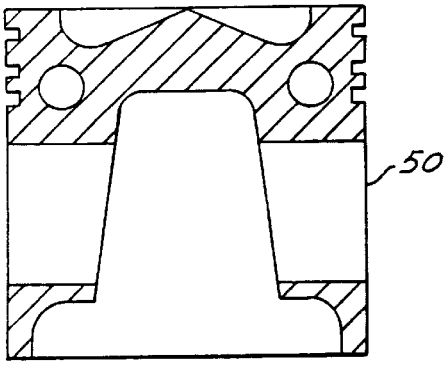
(PRIOR ART) FIG. 4A
Figure 4B:
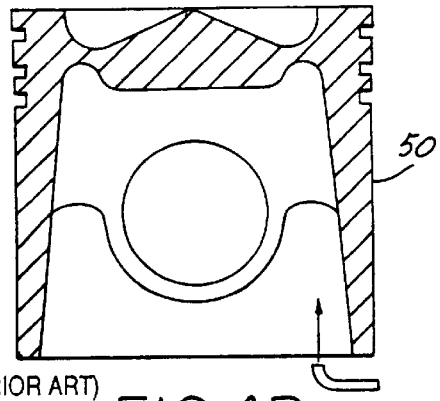
(PRIOR ART) FIG. 4B
Figure 4C:
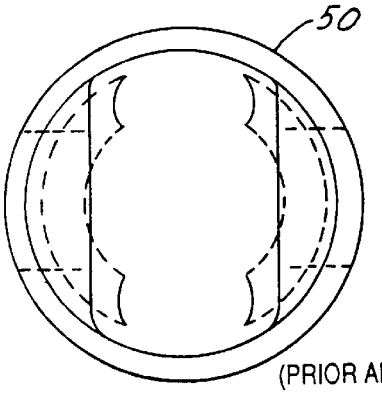
(PRIOR ART) FIG. 4C
Figure 5A:
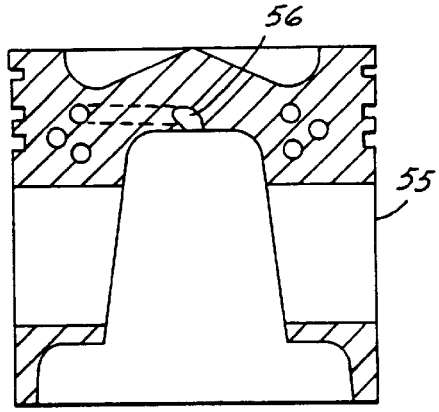
(PRIOR ART) FIG. 5A
Figure 5B:
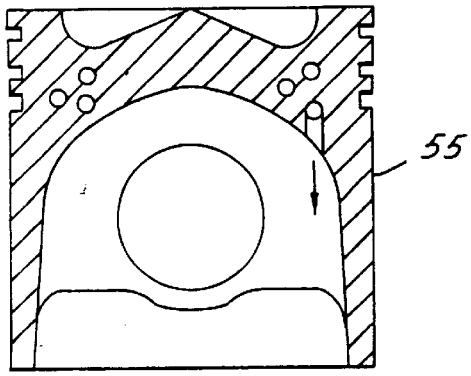
FIG. 5B (PRIOR ART)
Figure 5C:
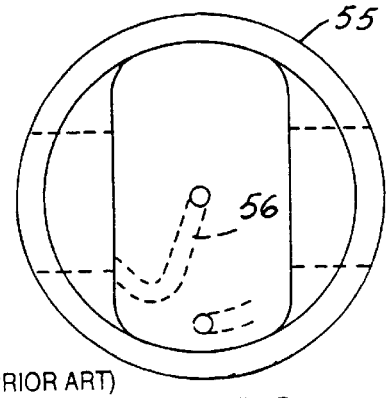
(PRIOR ART) FIG. 5C
Figure 6A:
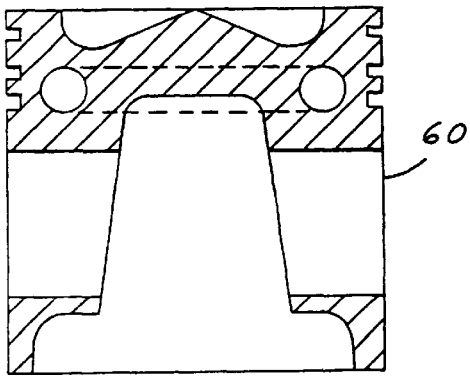
FIG.6A (PRIOR ART)
Figure 6C:
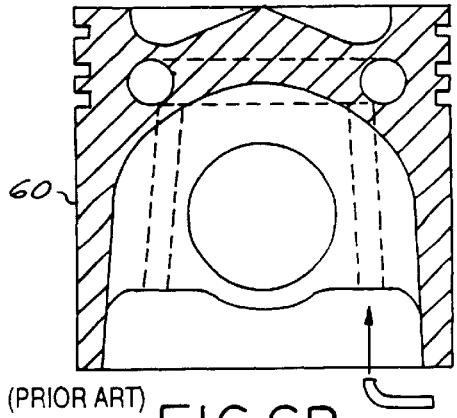
(PRIOR ART) FIG.6C
Figure 6C:
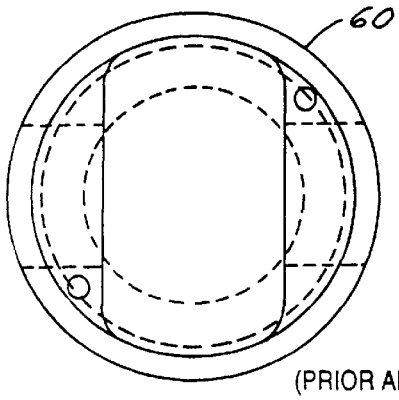
(PRIOR ART) FIG.6C
Figure 7B:
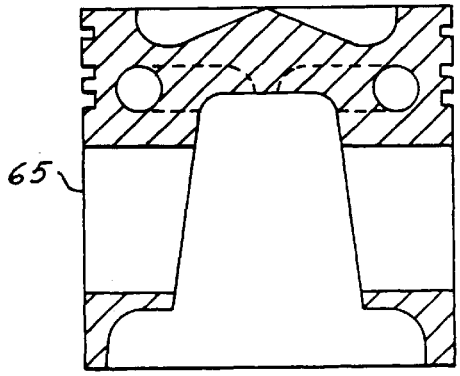
FIG.7B (PRIOR ART)
Figure 7B:
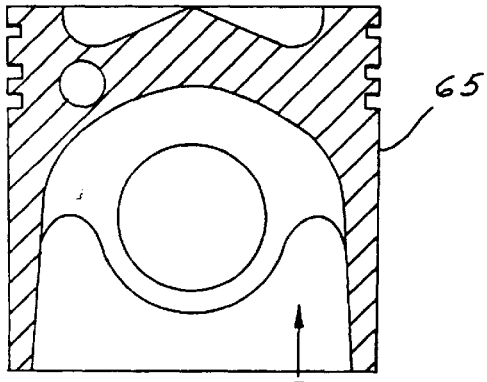
FIG.7B (PRIOR ART)
Figure 7C:
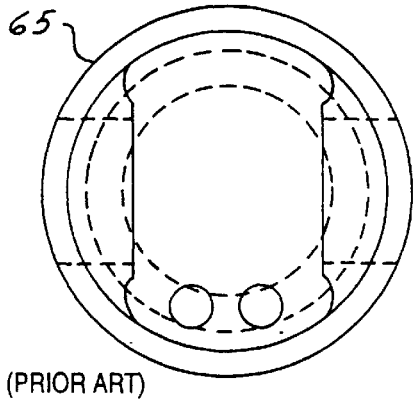
(PRIOR ART) FIG.7C
Figure 8A:
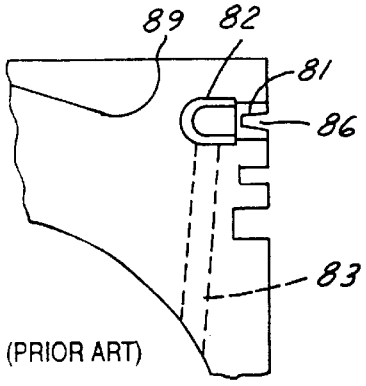
Figure 8B:
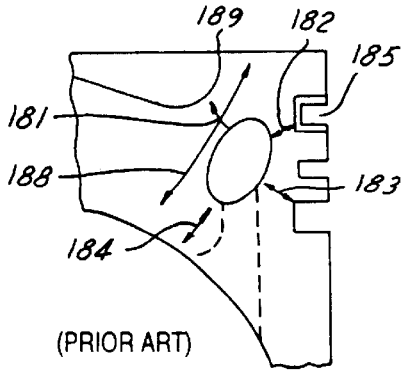
Figure 9A:
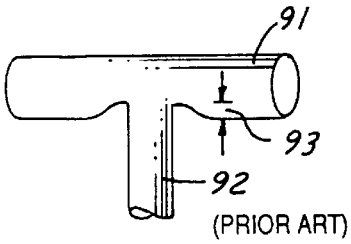
Figure 9B:
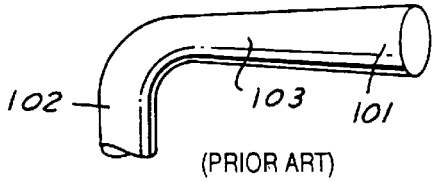
Figure 9C:
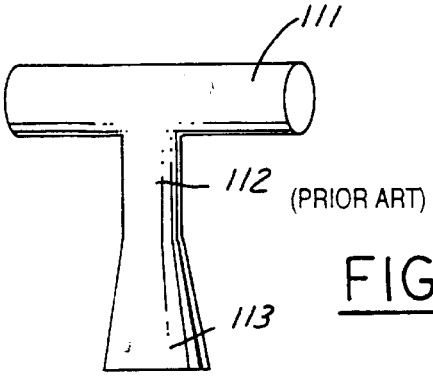

The coolant gallery variant of FIGS. 3I and 3J has extensions 35 with their axes in the radial direction. This would be most suitable for those cases where the hoop stresses are dominant and the axial stress on the bulk of the piston is low. Such would be the case in low peak pressure applications, with very high thermal loading.

Generally, the coolant gallery configurations, with localized extensions, of the present invention are particularly suitable for use with certain developments in piston to connecting rod joint and attendant coolant techniques disclosed in the Applicant's co-pending UK patent applications Nos. 9908844.5 and 9909033.4, the disclosures of which are hereby incorporated by reference herein.

Some embodiments of the present invention provide a coolant action of comparable performance to that of known blind-hole piston configurations, but are more suitable for the numerous smaller engines that typically power trucks, earth movers, buses, passenger cars, small aircraft and the like, and one which could equally be applied to larger engines.

While the invention has been described in connection with one or more embodiments, it is to be understood that the specific mechanisms and techniques which have been described are merely illustrative of the principles of the invention. Numerous modifications may be made to the methods and apparatus described without departing from the spirit and scope of the invention as defined by the appended claims.

What is claimed is:

1. A one-piece cast piston comprising a body member with a crown, a central cavity, an integral internal coolant gallery passageway, and a plurality of extension chambers connected to and extending from said passageway, at least one coolant feed/drain passage connecting said central cavity to said coolant gallery passageway, and said chambers being blind ended and formed in the piston when it is cast, wherein localized coolant flow is provided and a greater coolant surface contact area inside said body member is provided.

2. The one-piece cast piston as recited in claim 1 wherein said coolant gallery piston comprises an annular ring.

3. The one-piece cast piston as recited in claim 2 wherein said extension chambers are equally spaced around the circumference of said annular ring.

4. The one-piece cast piston as recited in claim 3 wherein said extension chambers are spaced between 12°–24° apart and there are between 15–30 extension chambers provided.

5. The one-piece cast piston as recited in claim 2 wherein said annular ring shaped coolant gallery passageway has a diameter of about 70% of the diameter of the piston.

6. The one-piece cast piston as recited in claim 2 wherein said extension chambers have a height of between 50%–150% of the diameter of said annular ring.

7. The one-piece cast piston as recited in claim 1 wherein said piston has a longitudinal axis and said extension chambers are orientated substantially parallel to said longitudinal axis.

8. The one-piece cast piston as recited in claim 1 wherein said blind ends of said extension chambers have a curved profile.

9. The one-piece cast piston as recited in claim 1 wherein said blind ends of said extension chambers have generally tapered cross-sections.

10. The one-piece cast piston as recited in claim 1 wherein said blind ends of said extension chamber have generally conical cross-sections.

11. The one-piece cast piston as recited in claim 1 wherein said piston has a longitudinal axis and said food/drain passageways are positioned substantially parallel to said longitudinal axis.

12. The one-piece cast piston as recited in claim 1 wherein said coolant gallery passageway comprises a open curved shaped annulus.

13. The one-piece cast piston as recited in claim 1 wherein said coolant gallery passageway has a generally circular cross-section.

14. The one-piece cast piston as recited in claim 1 wherein the spacing between said extension chambers is substantially the same as the width of said extension chambers.

15. The one-piece cast piston as recited in claim 1 wherein said piston has a longitudinal axis and at least one group of extension chambers are positioned extending in a direction toward said piston crown and at least a second group of extension chambers are positioned extending in a direction away from said piston crown and toward said central cavity.

16. A reciprocating piston-in-cylinder internal combustion engine incorporating at least one piston as set forth in claim 1.

17. A one-piece cast piston having a crown and a longitudinal axis comprising a body member with an annular shaped integral internal coolant gallery passageway and a plurality of connected extension chambers, said extension chambers being blind ended, being substantially equally spaced around the circumference of said passageway and extending in a direction substantially parallel to said longitudinal axis.

18. A one-piece cast piston as recited in claim 17 wherein at least a portion of said extension chambers extend in a direction other than toward said crown of said piston.

19. A one-piece cast piston as recited in claim 17 wherein said extension chambers have a profile selected from the group consisting of curved, tapered and conical.

20. The one-piece cast piston as recited in claim 17 wherein said passageway has a substantially circular cross-section and a diameter about 70% of the diameter of the piston, and said extension chambers have a length of between 50–150% of the diameter of said passageway.

* * * * *

UNITED STATES PATENT AND TRADEMARK OFFICE

CERTIFICATE OF CORRECTION

PATENT NO. : 7,281,466 B1
APPLICATION NO. : 09/552391
DATED : October 16, 2007
INVENTOR(S) : Mark Conrad Wilksch et al.

It is certified that error appears in the above-identified patent and that said Letters Patent is hereby corrected as shown below:

Column 10, line 21: "food/drain" should read -- feed/drain --

Signed and Sealed this

Thirtieth Day of November, 2010

David J. Kappos

David J. Kappos
*Director of the United States Patent and Trademark Office*